US006755613B1

(12) United States Patent
Schmitz

(10) Patent No.: US 6,755,613 B1
(45) Date of Patent: Jun. 29, 2004

(54) COMPONENT AND METHOD FOR PRODUCING A PROTECTIVE COATING ON A COMPONENT

(75) Inventor: Friedhelm Schmitz, Dinslaken (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/959,974

(22) PCT Filed: May 12, 2000

(86) PCT No.: PCT/EP00/04319

§ 371 (c)(1),
(2), (4) Date: Nov. 14, 2001

(87) PCT Pub. No.: WO00/70190

PCT Pub. Date: Nov. 23, 2000

(30) Foreign Application Priority Data

May 14, 1999 (EP) ..... 99109627

(51) Int. Cl.[7] ..... F01D 5/08
(52) U.S. Cl. ..... 415/200; 416/241 R
(58) Field of Search ..... 415/178, 200; 416/95, 223 R, 241 R; 427/456, 376.8, 383.7, 436, 252, 250

(56) References Cited

U.S. PATENT DOCUMENTS 4,950,552 A * 8/1990 Amend et al. ..... 428/626
5,120,613 A * 6/1992 Basler et al. ..... 428/653
5,270,081 A * 12/1993 Manier et al. ..... 427/376.8 X
5,447,754 A * 9/1995 Jasper ..... 427/436 X
5,547,769 A * 8/1996 Schmitz ..... 416/241 R
5,624,235 A * 4/1997 Siga et al. ..... 416/241 R
5,693,368 A * 12/1997 Ackerman et al. ..... 427/250 X

FOREIGN PATENT DOCUMENTS

| | | |
|---|---|---|
| EP | 0379699 A1 | 8/1990 |
| EP | 0743374 A1 | 11/1996 |
| WO | WO94/07004 | 3/1994 |
| WO | WO94/08071 | 4/1994 |

OTHER PUBLICATIONS

Patent Abstract of Japan, Japanese Patent Publication 9–228, 018, published on Sep. 2, 1997 (Kikko, "Aluminum Plated Steel Sheet Excellent in Brazability and Its Production").

* cited by examiner

*Primary Examiner*—Edward K. Look
*Assistant Examiner*—Richard A. Edgar
(74) *Attorney, Agent, or Firm*—Staas & Halsey LLP

(57) ABSTRACT

A steam turbine component coated with a protective layer can be exposed to hot vapor. The component has a metallic base body, to which the protective layer is bonded by diffusion in order to increase the resistance of the base material to oxidation. The protective layer contains aluminum and has a thickness of less than 50 $\mu$m. The protective coating can be formed by applying an aluminum pigment to the base body and maintaining the component at a predetermined temperature.

22 Claims, 3 Drawing Sheets

COMPONENT AND METHOD FOR PRODUCING A PROTECTIVE COATING ON A COMPONENT

CROSS REFERENCE TO RELATED APPLICATIONS

This application is based on and hereby claims priority to European Application No. 991096272 filed on May 14, 2001, and PCT Application No. PCT/EP00/04319 filed on May 12, 2000, the contents of which are hereby incorporated by reference.

BACKGROUND OF THE INVENTION

The invention relates to a component, in particular a component which can be exposed to hot vapor, having a metallic base body which has a protective coating in order to increase the resistance of the base material to oxidation. The invention also relates to a process for producing a protective coating in order to increase the resistance to oxidation on a component which can be exposed to hot vapor, having a metallic base body which has a base material.

In various technical fields, components are exposed to hot vapor, in particular steam. This applies, for example, to components used in steam installations, in particular in steam power plants. With a view to increasing the efficiency of steam power plants, the efficiency is increased, inter alia, by raising the steam parameters (pressure and temperature). Future developments will involve pressures of up to 300 bar and temperatures of up to over 650° C. To produce elevated steam parameters of this level, there is a need for suitable materials with a high creep strength at elevated temperatures.

Since austenitic steels, on account of unfavorable physical properties, such as a high coefficient of thermal expansion and low thermal conductivity, in this case meet their limits, numerous variants of ferritic-martensitic steels with a high creep strength and chromium contents of from 9% by weight to 12% by weight are currently being developed.

EP 0 379 699 A1 has disclosed a process for increasing the resistance of a blade of a thermal machine, in particular a blade of an axial compressor, to corrosion and oxidation.

The base material of the compressor blade in this case is formed of a ferritic-martensitic material. A securely adhered surface-protection layer comprising 6 to 15% by weight of silicon, remainder aluminum, is sprayed onto the base material using the high-speed method with a particle velocity of at least 300 m/s onto the surface of the base material. A conventional paint-spraying process is used to apply a plastic, for example polytetrafluoroethylene, to this metal protective layer, which plastic forms the covering layer (outer layer) of the blade. The process provides a protective layer on a blade which has an increased resistance to corrosion and erosion in the presence of steam and at relatively moderate temperatures (450° C.), as are relevant to compressor blades.

The article "Werkstoffkonzept für hochbeanspruchte Dampfturbinen-Bauteile", by Christina Berger and Jürgen Ewald in Siemens Power Journal April 1994, pp. 14–21, has provided an analysis of the materials properties of forged and cast chromium steels. The creep strength of chromium steels containing 2 to 12% by weight of chromium and additions of molybdenum, tungsten, niobium and vanadium decreases continuously as the temperature rises. For use at temperatures of over 550 to 600° C., forged shafts are described, which contain from 10 to 12% by weight of chromium, 1% of molybdenum, 0.5 to 0.75% by weight of nickel, 0.2 to 0.3% by weight of vanadium, 0.12 to 0.23% by weight of carbon and optionally 1% by weight of tungsten. Castings produced from chromium steel are used in valves for a steam turbine, outer and inner casings of high-pressure, medium-pressure, low-pressure and saturated-steam turbines. For valves and casings which are exposed to temperatures of 550 to 600° C., steels which contain 10 to 12% by weight of chromium are used, and these steels may in addition contain 0.12 to 0.22% by weight of carbon, 0.65 to 1% by weight of manganese, 1 to 1.1% by weight of molybdenum, 0.7 to 0.85% by weight of nickel, 0.2 to 0.3% by weight of vanadium or also 0.5 to 1% by weight of tungsten.

The article "Steam Turbine Materials: High Temperature Forgings" by C. Berger et al., $5^{th}$ Int. Conf. Materials for Advanced Power Engineering, Liege, Belgium, Oct. 3–6, 1994, provides a summary of the development of CrMoV steels which contain from 9 to 12% by weight of chromium and have a high creep strength. These steels are in this case used in steam power installations, such as conventional steam power plants and nuclear power plants. Components produced from chromium steels of this type are, for example, turbine shafts, casings, bolts, turbine blades, pipelines, turbine-wheel disks and pressure vessels. A further summary of the development of new materials, in particular 9–12% by weight chromium steels, is given by the article "Material development for high temperature-stressed components of turbomachines" by T. -U. Kern et al. in Stainless Steel World, October 1998, pp. 19–27.

Further application examples for chromium steels containing 9% by weight to 13% by weight of chromium are given, for example, in U.S. Pat. No. 3,767,390. The martensitic steel used in this document is employed for steam-turbine blades and the bolts which hold together the casing halves of a steam turbine.

EP 0 639 691 A1 has disclosed a turbine shaft for a steam turbine which contains 8 to 13% by weight of chromium, 0.05 to 0.3% by weight of carbon, less than 1% of silicon, less than 1% of manganese, less than 2% of nickel, 0.1 to 0.5% by weight of vanadium, 0.5 to 5% by weight of tungsten, 0.025 to 0.1% by weight of nitrogen, up to 1.5% by weight of molybdenum, and also between 0.03 and 0.25% by weight of niobium or 0.03 and 0.5% by weight of tantalum or less than 3% by weight of rhenium, less than 5% by weight of cobalt, less than 0.05% by weight of boron, with a martensitic structure.

WO 91/08071 relates to a protective layer protecting against corrosive and erosive attack at a temperature of up to approximately 500° C. for a substrate formed of a chromium steel. A protective layer which contains aluminum is formed on the substrate. The aluminum-containing protective layer is applied electrochemically, in particular by electrodeposition, and is hardened or age-hardened at least on its surface in order to form the protective layer. As a result, a so-called duplex layer is formed, which comprises the metal layer and the hard layer.

SUMMARY OF THE INVENTION

It is an object of one aspect of the invention to provide a component which can be exposed to hot vapor, having a metallic base body, which has an increased resistance to oxidation compared to the metallic base body. A further possible object of the invention is to describe a process for producing a protective coating in order to increase the resistance to oxidation of the base material on a component.

According to one aspect of the invention, the object relating to a component is achieved by the fact that the component has a protective layer, which has a thickness of less than 50 μm and contains aluminum, on the base material.

One aspect of the invention is based on the discovery that, when a base material is used at elevated temperatures, for example in steam power plants, as well as a high creep strength a considerable resistance to oxidation in the steam is also necessary. The oxidation of the base materials in some cases increases considerably as the temperature rises. This oxidation problem is intensified by the reduction in the chromium content of the steels used, since chromium as an alloying element has a positive influence on the resistance to scaling. Therefore, a lower chromium content can increase the rate of scaling. By way of example, in the case of steam generator tubes, thick oxidation layers on the steam side may lead to a deterioration in the heat transfer from the metallic base material to the steam and therefore to the temperature of the pipe wall rising and to the service life of the steam-generator pipes being reduced. In steam turbines, by way of example jamming of screw connections and valves caused by scaling and an additional load caused by the growth of scale in blade grooves, or flaking of scale at blade outlet edges, could lead to an increase in the notch stress.

Because it has an adverse effect on the mechanical properties of the base material, the possibility of the resistance to scaling by changing the alloying composition of the base material using elements which reduce scaling, such as chromium, aluminum and/or silicon, in an increased concentration is ruled out. By contrast, one aspect of the invention, which has a thin aluminum-enriched zone of the base material, already increases the resistance of the base material to oxidation by up to more than one order of magnitude. Furthermore, this allows fully machined components to be protected without problems, by providing them with an oxidation coating of this type. On account of the low thickness of the protective layer, there is also no adverse effect on the mechanical properties of the base material. The protective layer is in this case to a large extent, possibly completely, formed by the diffusion of aluminum into the base material or by the reverse process. Corresponding diffusion of the aluminum into the base material and of elements of the base material into an aluminum layer may take place as part of a heat treatment carried out at below the tempering temperature of the base material, so that there is no need for a further heat treatment of the component. If appropriate, diffusion of this type may also take place when the component is being used at the prevailing temperatures. A high adhesive strength is achieved as a result of the metallic bonding between the aluminum and the alloying elements of the base material. Moreover, the protective layer has a high hardness, so that it is also highly resistant to abrasion. Furthermore, it is also possible to achieve a particularly uniform formation of the layer thickness of the protective layer even at locations which are difficult to gain access to, on account of simple application methods being used.

The thickness of the protective layer is preferably less than 20 μm, in particular less than 10 μm. It may preferably be between 5 and 10 μm.

The proportion of aluminum in the protective layer is preferably over 50% by weight.

The protective layer preferably contains, in addition to aluminum, iron and chromium, which may, for example, have diffused into the protective layer from a base material or have been applied to the base material, together with an aluminum-containing layer. Furthermore, the protective layer may, in addition to aluminum, also contain silicon, in particular in a proportion of up to 20% by weight. Suitable addition of silicon enables the hardness of the protective layer, as well as other mechanical properties, to be set as desired.

The base material of the component is preferably a chromium steel. It may contain between 0.5% by weight and 2.5% by weight of chromium, and also between 8% by weight and 12% by weight of chromium, in particular between 9% by weight and approximately 10% by weight of chromium. As well as chromium, a chromium steel of this type may also contain between 0.1 and 1.0, preferably 0.45% by weight of manganese. It may also contain carbon in a proportion of between 0.05 and 0.25% by weight, silicone in a proportion of less than 0.6% by weight, preferably approximately 0.1% by weight, molybdenum in a proportion of between 0.5 and 2% by weight, preferably approximately 1% by weight; nickel in a proportion of up to 1.5% by weight, preferably 0.74% by weight; vanadium in a proportion of between 0.1 and 0.5% by weight, preferably approximately 0.18% by weight; tungsten in a proportion of between 0.5 and 2% by weight, preferably 0.8% by weight; niobium in a proportion of up to 0.5% by weight, preferably approximately 0.045% by weight; nitrogen in a proportion of less than 0.1% by weight, preferably approximately 0.05% by weight, and if appropriate an addition of boron in a proportion of less than 0.1% by weight, preferably approximately 0.05% by weight.

The base material is preferably martensitic or ferritic-martensitic or ferritic.

The component which has the thin protective layer is preferably a component of a steam turbine or a component of a steam generator, in particular a steam-generator pipe. The component may be a forging or a casting. A component of a steam turbine may in this case be a turbine blade, a valve, a turbine shaft, a wheel disk of a turbine shaft, a connecting element, such as a screw, a bolt, a nut, etc., a casing component (inner casing, guide-vane support, outer casing), a pipeline or the like.

The object relating to a process for producing a protective coating for increasing the resistance to oxidation on a component which can be exposed to hot vapor may be achieved by the fact that a layer which is less than 50 μm thick and contains aluminum pigment is applied to a metallic base body, which has a base material, and the component is held at a temperature which is lower than the tempering temperature of the base material, so that a reaction takes place between the aluminum and the base material in order to form an aluminum-containing protective layer.

The aluminum-containing layer is in this case preferably held at a temperature in the region of the melting temperature of aluminum, in particular between 650° C. and 720° C., in order to carry out the diffusion. The temperature may also be lower. If appropriate, the diffusion may also take place while the component is being used in a steam plant at the prevailing temperature of use. The component is exposed to the appropriate temperature for carrying out the reaction for at least 5 min, preferably over 15 min, if appropriate even for a few hours.

The layer containing the aluminum is preferably applied in a thickness, in particular a mean thickness, of between 5 μm and 30 μm, in particular between 10 μm and 20 μm. The thin layer containing aluminum pigment is, for example, applied by an inorganic high-temperature coating. The layer may be applied by being sprayed on, with the result that a suitable protective coating of the component can be achieved even at locations which are difficult to gain access to. A heat treatment of the component in order to carry out the reaction between base material and coating can take place, for example, in the furnace or by using other suitable heat sources.

After the heat treatment of the applied layer containing aluminum pigment has been carried out, a substantially continuous protective layer, which is approx. 5 to 10 $\mu$m thick and contains Fe—Al—Cr, can be formed, i.e. in the form of an intermetallic compound between aluminum and the base material. The application of the layer to a chromium steel leads to a considerable improvement of the scaling behavior of the base material. On account of a high aluminum content, in particular of over 50% by weight, in the protective layer which is formed as a result of reaction between the aluminum pigments and the base material, in particular a diffusion layer, the resistance of the component to oxidation is considerably increased. The protective layer formed in this way has a high hardness (Vickers Hardness HV) of, for example, approximately 1200.

Alternatively, the application of a thin aluminum-containing layer of this type may also take place by an adapted dip-aluminizing process. The change in the dip-aluminizing process is carried out in such a way that, compared to the standard aluminum-containing layer thicknesses of between 20 and 400 $\mu$m, the layer thickness is reduced accordingly. Aluminum hot-dip layers produced by the hot-dip process form a plurality of phases (Eta phase/$Fe_2Al_5$; Zeta phase/$FeAl_2$, Theta phase/$FeAl_3$) with iron. In the conventional hot-dipping (hot-dip aluminizing) for simple steel parts, suitably pretreated components which are to be coated are immersed in molten aluminum or aluminum alloy baths at temperatures of from 650° C. to 800° C. and are pulled out again after a residence time of 5 to 60 sec. In the process, an intermetallic protective layer and, on this, an aluminum covering layer are formed. These coatings which are produced by conventional hot-dip aluminizing present the risk, however, that the top aluminum covering layers introduce aluminum into the steam cycle as a result of the action of steam, which could cause undesirable accompanying phenomena, such as relatively insoluble aluminum silicate deposits.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
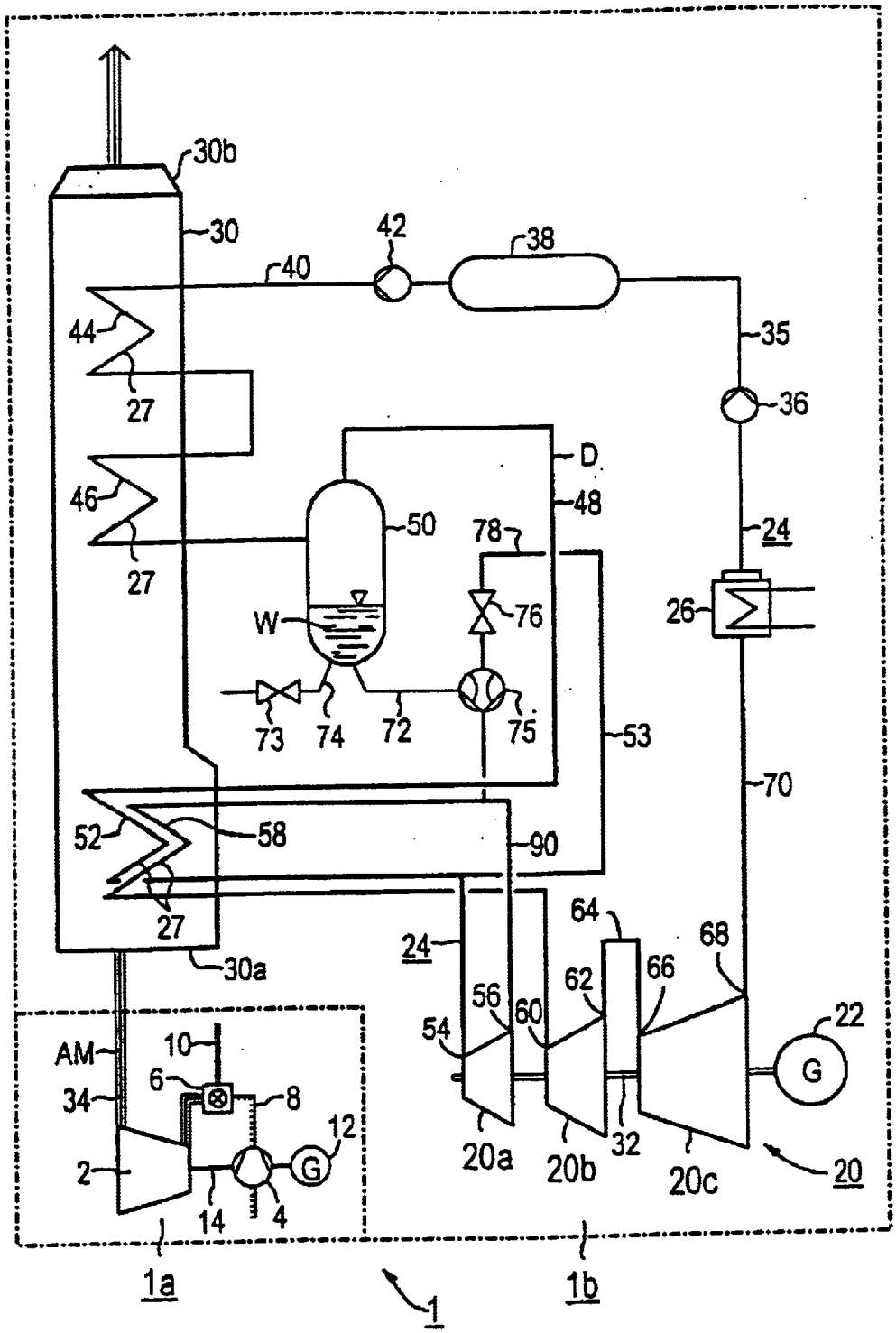
FIG. 1 diagrammatically depicts a steam power plant.

Reference will now be made in detail to the preferred embodiments of the present invention, examples of which are illustrated in the accompanying drawings, wherein like reference numerals refer to like elements throughout.

FIG. 1 shows a steam power plant 1 with a steam turbine plant 1*b*. The steam turbine plant 1*b* comprises a steam turbine 20 with coupled generator 22 and, in a steam cycle 24 assigned to the steam turbine 20, a condenser 26, which is connected downstream of the steam turbine 20, and a steam generator 30. The steam generator 30 is designed as a continuous heat recovery steam generator and is exposed to hot exhaust gas from a gas turbine 1*a*. The steam generator 30 may alternatively also be designed as a steam generator which is fired with coal, oil, wood, etc. The steam generator 30 has a multiplicity of pipes 27, in which the steam for the steam turbine 20 is generated and which may have a protective layer 82 (cf. FIG. 3) to protect against oxidation. The steam turbine 20 comprises a high-pressure partial turbine 20*a*, a medium-pressure partial turbine 20*b* and a low-pressure partial turbine 20*c*, which drive the generator 22 via a common shaft 32.

The gas turbine la comprises a turbine 2 with coupled air compressor 4 and a combustion chamber 6 which is connected upstream of the turbine 2 and is connected to a fresh-air line 8 of the air compressor 4. A fuel line 10 opens into the combustion chamber 6 of the turbine 2. The turbine 2 and the air compressor 4, as well as a generator 12, are positioned on a common shaft 14. To supply flue gas or operating medium AM which is expanded in the gas turbine 2, an exhaust-gas line 34 is connected to an inlet 30*a* of the continuous steam generator 30. The expanded operating medium AM (hot gas) of the gas turbine 2 leaves the continuous steam generator 30 via its outlet 30*b*, toward a stack (not shown in more detail).

The condenser 26 connected downstream of the steam turbine 20 is connected to a feedwater tank 38 via a condensate line 35 in which a condensate pump 36 is incorporated. On the outlet side, the feedwater tank 38 is connected, via a main feedwater line 40, in which a feedwater pump 42 is incorporated, to an economizer or high-pressure preheater 44 arranged in the continuous steam generator 30. On the outlet side, the high-pressure preheater 44 is connected to an evaporator 46 designed for continuous operation. For its part, the evaporator 46 is connected on the outlet side to a superheater 52 via a steam line 48, in which a water separator 50 is incorporated. In other words: the water separator 50 is connected between the evaporator 46 and the superheater 52.

On the outlet side, the superheater 52 is connected, via a steam line 53, to the steam inlet 54 of the high-pressure part 20*a* of the steam turbine 20. The steam outlet 56 of the high-pressure part 20*a* of the steam turbine 20 is connected, via an intermediate superheater 58, to the steam inlet 60 of the medium-pressure part 20*b* of the steam turbine 20. The steam outlet 62 of the medium-pressure part 20*b* of the steam turbine 20 is connected via an overflow line 64 to the steam inlet 66 of the low-pressure part 20*c* of the steam turbine 20. The steam outlet 68 of the low-pressure part 20*c* of the steam turbine 20 is connected to the condenser 26 via a steam line 70, so that a continuous steam cycle 24 is formed.

An extractor line 72 for water W which has been separated off is connected to the water separator 50 connected between the evaporator 46 and the superheater 52. In addition, an outlet line 74 which can be closed off by a valve 73 is connected to the water separator 50. The outlet line 72 is connected on the outlet side to a jet pump 75, which on the primary side can be acted on by medium removed from the steam cycle 24 of the steam turbine 20. On the primary side, the jet pump 75 is likewise connected on the outlet side to the steam cycle 24. The jet pump 75 is incorporated in a steam line 78 which is connected on the inlet side to the steam line 53 and therefore to the outlet of the superheater 52 and can be closed off by a valve 76. On the outlet side, the steam line 78 opens into a steam line 90 which connects the steam outlet 56 of the high-pressure part 20*a* of the steam turbine 20 to the intermediate superheater 58. In the exemplary embodiment shown in FIG. 1, the jet pump 75 can therefore be operated by steam D removed from the steam cycle 24 as its working fluid. Depending on the particular requirements, components of the steam power plant 1*b* may be provided with an aluminum-containing protective layer with a thickness of less than 50 μm (cf. FIG. 3).

Figure 2:
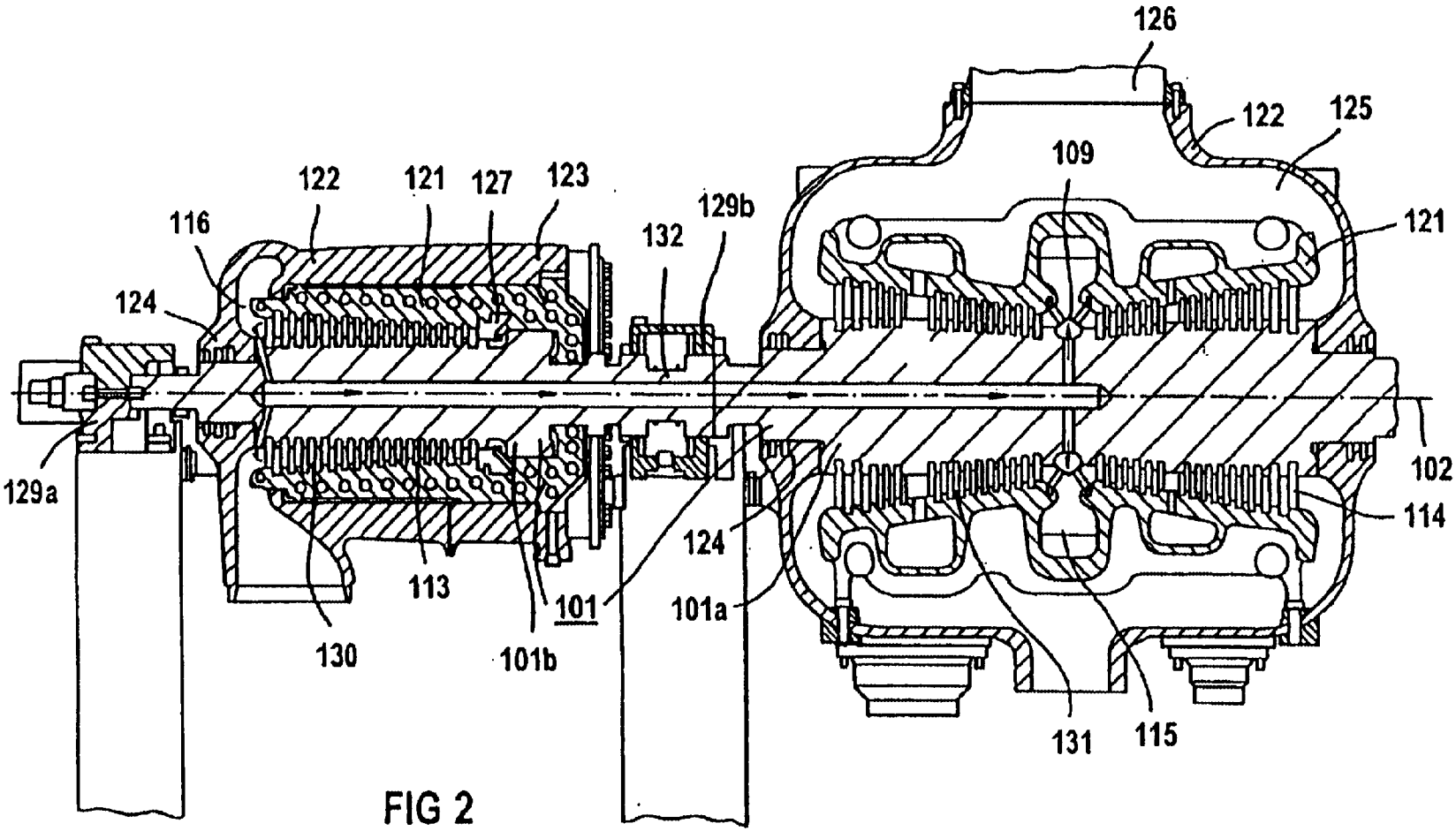
FIG. 2 shows a diagrammatic section through a steam turbine arrangement.

FIG. 2 illustrates a diagrammatic longitudinal section through part of a steam turbine plant with a turbine shaft 101 extending along an axis of rotation 102. The turbine shaft 101 is composed of two partial turbine shafts 101*a* and 101*b*, which are securely connected to one another in the region of the bearing 129*b*. The steam turbine plant has a high-pressure partial turbine 123 and a medium-pressure partial turbine 125, each with an inner casing 121 and an outer casing 122 which surrounds the latter. The high-pressure partial turbine 123 is of dish-like design. The medium-pressure partial turbine 125 is of double-flow design. It is also possible for the medium-pressure partial turbine 125 to be of single-flow design. A bearing 129*b* is arranged along the axis of rotation 102, between the high-pressure partial turbine 123 and the medium-pressure partial turbine 125, the turbine shaft 101 having a bearing region 132 in the bearing 129*b*. The turbine shaft 101 is mounted on a further bearing 129*a* next to the high-pressure partial turbine 123. In the region of this bearing 129*a*, the high-pressure partial turbine 123 has a shaft seal 124. The turbine shaft 101 is sealed with respect to the outer casing 122 of the medium-pressure partial turbine 125 by two further shaft seals 124. Between a high-pressure steam inlet region 127 and a steam outlet region 116, the turbine shaft 101 has rotor blades 113 in the high-pressure partial turbine 123. A row of guide vanes 130 is positioned in front of each row of rotor blades 113, as seen axially in the direction of flow of the steam. The medium-pressure partial turbine 125 has a central steam inlet region 115. Assigned to the steam inlet region 115, the turbine shaft 101 has a radially symmetrical shaft screen 109, a covering plate, which serves firstly to divide the steam flow between the two flows of the medium-pressure partial turbine 125 and secondly to prevent direct contact between the hot steam and the turbine shaft 101. In the medium-pressure partial turbine 125, the turbine shaft 101 has medium-pressure guide vanes 131 and medium-pressure rotor blades 114. The steam which flows out of an outlet connection piece 126 from the medium-pressure partial turbine 125 passes to a low-pressure partial turbine, which is connected downstream in terms of flow and is not illustrated.

Figure 3:
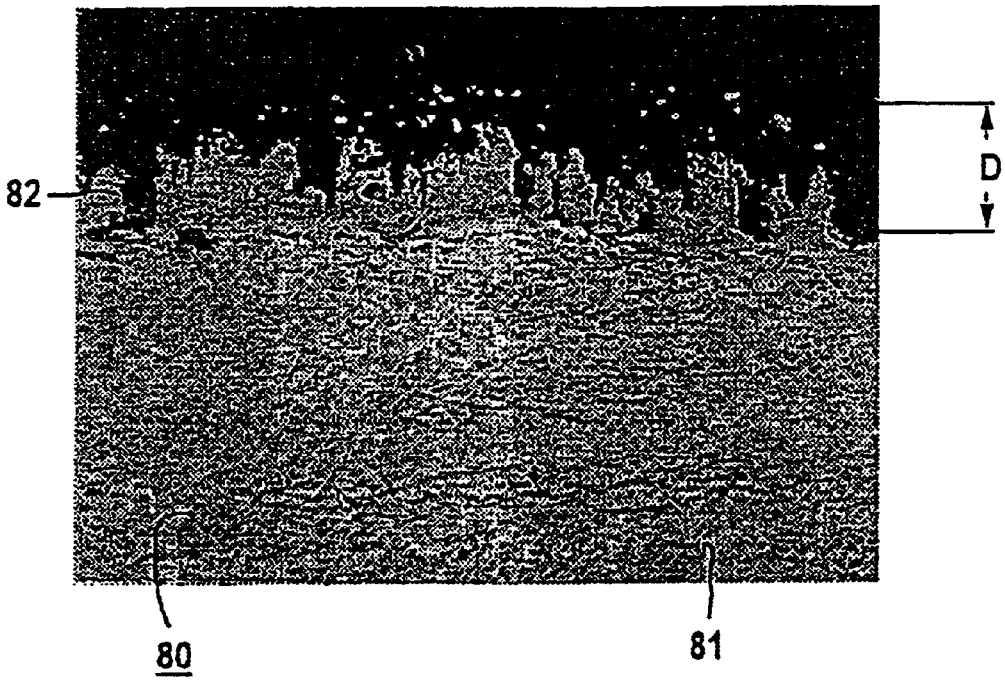
FIG. 3 shows a microsection through an aluminum-containing protective layer.

FIG. 3 shows part of a longitudinal section through a region which is close to the surface of a component 80, which is part of a steam turbine plant, such as, for example, a steamgenerator pipe 27, a turbine shaft 101, a turbine outer casing 122, an inner casing 121 (guide-vane support), a shaft screen 109, a valve or the like. The component 80 has a base material 81, for example a chromium steel containing 9 to 12% by weight of chromium and, if appropriate, further alloying elements, such as molybdenum, vanadium, carbon, silicon, tungsten, manganese, niobium, remainder iron. The base material 81 merges into a protective layer 82, which contains up to more than 50% by weight of aluminum. The mean thickness D of the protective layer 82 is approximately 10 μm. The section which is shown has been microscopically enlarged a thousand times.

The base material 81 in this case has a Vickers hardness of approximately 300, and the protective layer has a Vickers hardness of approximately 1200. The resistance to oxidation and therefore the resistance to scaling of the component 80 is increased considerably by the protective layer 82, even at high steam temperatures of up to over 650° C., which considerably extends the service life of the component 80 when used in a steam turbine plant or when exposed to steam at over 600° C. The metallic protective layer 82 at the same time forms the outer surface (covering layer) of the component 80 which has the protective layer 82. The outer surface of the protective layer 82 is acted on by hot steam when the steam turbine plant is in operation.

The invention has been described in detail with particular reference to preferred embodiments thereof and examples, but it will be understood that variations and modifications can be effected within the spirit and scope of the invention.

What is claimed is:

1. A steam turbine component comprising:

a metallic base body made from a base material; and a protective layer formed of aluminum and bonded to the base body in order to increase the resistance of the base material to oxidation, which protective layer has an aluminum-enriched zone, which faces the base body, the aluminum-enriched zone being formed of an intermetallic compound between of aluminum diffused into the base material, the protective layer forming an outer surface of the component such that when the steam turbine is operating, the protective layer is exposed to hot vapor, the protective layer having a thickness of less than 20 μm, and the proportion of aluminum in the protective layer being over 50% by weight.

2. The steam turbine component as claimed in claim 1, wherein the thickness of the protective layer is less than 10 μm.

3. The steam turbine component as claimed in claim 1, wherein the thickness of the protective layer is between 5 μm and 10 μm.

4. The steam turbine component as claimed in claim 1, wherein the protective layer, in addition to the aluminum, also contains iron and chromium.

5. The steam turbine component as claimed in claim 1, wherein the protective layer, in addition to aluminum, also contains silicon.

6. The steam turbine component as claimed in claim 5, wherein the protective layer contains silicon in an amount of 20% of weight or less.

7. The steam turbine component as claimed in claim 1, wherein the base material is a chromium steel.

8. The steam turbine component as claimed in claim 7, wherein the chromium steel contains between 0.5% by weight of chromium and 2.5% by weight of chromium.

9. The steam turbine component as claimed in claim 7, wherein the chromium steel contains between 8% by weight and 12% by weight of chromium.

10. The steam turbine component as claimed in claim 7, wherein the base material is martensitic, ferritic-martensitic or ferritic.

11. The steam turbine component as claimed in claim 1, wherein the component is a forged component or a cast component.

12. The steam turbine component as claimed in claim 11, wherein the component is selected from the group consisting of a turbine blade, a valve, a turbine shaft, a wheel disk of a turbine shaft, a connecting element, a housing component, and a pipeline.

13. The steam turbine component as claimed in claim 1, wherein the component is a steam-generator pipe.

14. A process for producing a protective coating on a base body of a steam turbine component in order to increase a resistance to oxidation, comprising:

applying a protective layer on the base body, the base body being formed of a metallic base material, the protective layer being less than 50 μm thick and containing aluminum pigment, and maintaining the steam turbine component at a predetermined temperature lower than a tempering temperature of the base material, in order for the protective layer to react with the base material and form an aluminum-enriched zone facing the base body, the aluminum-enriched zone being formed of an intermetallic compound between aluminum and the base material, the proportion of aluminum in the protective layer being over 50% by weight.

15. The process as claimed in claim 14, wherein the steam turbine component with the protective layer is held at the predetermined temperature in the region of the melting temperature of aluminum.

16. The process as claimed in claim 14, wherein the predetermined temperature is between 650° C. and 720° C.

17. The process as claimed in claim 14, wherein the steam turbine component is exposed to the predetermined temperature for at least 5 minutes.

18. The process as claimed in claim 14, wherein the steam turbine component is exposed to the predetermined temperature for more than 15 minutes.

19. The process as claimed in claim 14, wherein the protective layer is applied in a thickness of between 5 μm and 30 μm.

20. The process as claimed in claim 14, wherein the protective layer is applied in a thickness of between 10 μm and 20 μm.

21. The process as claimed in claim 14, wherein the protective layer is applied as an inorganic high-temperature coating.

22. The process as claimed in claim 14, wherein the protective layer is applied by dip aluminizing.

* * * * *